US010767968B2

(12) United States Patent
Quertelet et al.

(10) Patent No.: US 10,767,968 B2
(45) Date of Patent: Sep. 8, 2020

(54) MISSILE PROVIDED WITH A SEPARABLE NOSE CONE COMPRISING AT LEAST ONE EJECTABLE SHELL COOPERATING WITH A SUPPORT ELEMENT

(71) Applicant: MBDA France, Le Plessis Robinson (FR)

(72) Inventors: Clément Quertelet, Le Plessis Robinson (FR); Clyde Laheyne, Le Plessis Robinson (FR)

(73) Assignee: MBDA France, Le Plessis Robinson (FR)

( * ) Notice: Subject to any disclaimer, the term of this patent is extended or adjusted under 35 U.S.C. 154(b) by 0 days.

(21) Appl. No.: 16/500,528

(22) PCT Filed: Feb. 19, 2018

(86) PCT No.: PCT/FR2018/000032
§ 371 (c)(1),
(2) Date: Oct. 3, 2019

(87) PCT Pub. No.: WO2018/193170
PCT Pub. Date: Oct. 25, 2018

(65) Prior Publication Data

US 2020/0049474 A1 Feb. 13, 2020

(30) Foreign Application Priority Data

Apr. 21, 2017 (FR) ..... 17 00448

(51) Int. Cl.
*F42B 10/46* (2006.01)

(52) U.S. Cl.
CPC ..... *F42B 10/46* (2013.01)

(58) Field of Classification Search
USPC ..... 102/520, 521, 522, 523
See application file for complete search history.

(56) References Cited

U.S. PATENT DOCUMENTS 3,706,281 A * 12/1972 Hatakeyama ..... F42B 15/36 102/378
5,263,418 A * 11/1993 Dippold ..... F42B 14/064 102/509

(Continued)

FOREIGN PATENT DOCUMENTS

JP H06313699 A 11/1994

OTHER PUBLICATIONS

International Search Report dated Apr. 26, 2018, issued in corresponding International Application No. PCT/FR2018/000032, filed Feb. 19, 2018, 5 pages.

(Continued)

*Primary Examiner* — Bret Hayes
(74) *Attorney, Agent, or Firm* — Christensen O'Connor Johnson Kindness PLLC

(57) ABSTRACT

A missile includes a separable nose cone having an ejectable shell cooperating with a support element. The missile has a body with a main longitudinal axis and a nose cone having a shell connected by a rear end thereof to a support element of the missile and defined around a secondary longitudinal axis. The support element has a housing, and the rear end of the shell has a thickness adapted to be received in the housing in a contacting manner. The housing is configured to allow the shell to pivot and to maintain contact while the orientation of the shell is such that the secondary longitudinal axis is at an angle smaller than an ejection angle in relation to said main longitudinal axis, and to end the contact when the secondary longitudinal axis is at an angle higher than or equal to the ejection angle in such a way as to eject the shell from the missile.

20 Claims, 4 Drawing Sheets

(56) References Cited

U.S. PATENT DOCUMENTS

| | | | | |
|---|---|---|---|---|
| 5,479,861 | A * | 1/1996 | Kinchin | F42B 14/064 102/439 |
| 6,494,406 | B1 * | 12/2002 | Fukushima | B64G 1/002 244/173.3 |
| 7,093,799 | B1 * | 8/2006 | Dulat | F42B 10/46 244/117 R |
| 7,549,376 | B1 * | 6/2009 | Grossman | F42B 10/50 102/400 |
| 8,069,791 | B1 * | 12/2011 | Kunstmann | F42B 14/064 102/520 |
| 8,519,312 | B1 * | 8/2013 | Merems | F42B 10/46 244/1 R |
| 2005/0000383 | A1 | 1/2005 | Facciano et al. | |
| 2011/0192308 | A1 * | 8/2011 | Fisch | F42B 15/36 102/377 |
| 2013/0214093 | A1 | 8/2013 | White et al. | |
| 2016/0102953 | A1 * | 4/2016 | Kalifa | F42B 14/064 102/521 |
| 2017/0131076 | A1 * | 5/2017 | Quertelet | F42B 10/46 |
| 2017/0167838 | A1 * | 6/2017 | Quertelet | F42B 10/46 |

OTHER PUBLICATIONS

Written Opinion of the International Searching Authority dated Apr. 26, 2018, issued in corresponding International Application No. PCT/FR2018/000032, filed Feb. 19, 2018, 7 pages.

Written Opinion of the International Searching Authority dated Apr. 26, 2018, issued in corresponding International Application No. PCT/FR2018/000032, filed Feb. 19, 2018, 9 pages.

International Preliminary Report on Patentability dated Oct. 22, 2019, issued in corresponding International Application No. PCT/FR2018/000032, filed Feb. 19, 2018, 1 page.

* cited by examiner

MISSILE PROVIDED WITH A SEPARABLE NOSE CONE COMPRISING AT LEAST ONE EJECTABLE SHELL COOPERATING WITH A SUPPORT ELEMENT

The present invention concerns a missile provided with at least one ejectable shell forming part of a droppable or separable protective nose cone.

The present invention is applied, more particularly although not exclusively, to a missile comprising at least one propellant stage which is intended to propel the missile and which can be separated from the latter, as well as a terminal vehicle which is arranged at the front of this propellant stage and which carries out a terminal flight towards a target. Generally, such a terminal vehicle comprises at least one sensor forming part, for example, of a seeker, which is temperature-sensitive.

Although not exclusively, the present invention more specifically applies to a missile presenting a flying area remaining in the atmosphere and which has kinematic performances making it possible to bring the terminal vehicle to supersonic speeds. At these high speeds, the surface temperature of the missile can reach several hundred degrees Celsius under the effect of the aerothermal flow, which can be detrimental for the holding and the performances of the structures, electronic equipment and sensors present. Also, the missile is generally provided at the front with a protective nose cone, which generally comprises several individual shells, an which is intended to thermally and mechanically protect the terminal vehicle.

This protective nose cone, and at least some and preferably all of the shells, must be able to be removed at the right moment, in particular to make it possible to use the sensor placed on the terminal vehicle in the terminal phase of the flight.

Furthermore, in particular to ensure a good trajectory of the missile, the ejection angle of the shells must be controlled, i.e. the angle from which the shells of the nose cone are no longer connected to the body of the missile.

Different usual systems are known to eject the shells with the following problems. In particular:

- on subsonic missile flying in a low atmosphere, simply, generally, it is ensured that the shells of the nose cone do not close under the effect of the aerodynamic flow by guaranteeing a minimum opening angle. This is incompatible with a low-altitude and high-speed separation, as the shells would thus have a too important rotation speed and would risk to suddenly fall back on the body of the missile;
- during the whole pre-decapping phase (transport logistics, flight, etc.), the nose cone is subjected to important loading factors likely to deform it. This is why usual articulation solutions do not make it possible to maintain the base of the nose cone; and
- an architecture which provides that the shells of the protective nose cone are articulated on the terminal vehicle, generates a important residual mass on the vehicle, due in particular to the mass of hinges or articulations of the shells used for this purpose, and penalises its performances during the terminal flight, that is the most crucial phase.

These usual solutions are not satisfactory to make it possible for an ejection of at least one shell of a nose cone of the missile in the applications considered (for example, at a low altitude and at a high speed).

The present invention aims to overcome this disadvantage. It relates to a missile provided with a body presenting a longitudinal axis called main longitudinal axis and at least one separable nose cone, said nose cone comprising at least one ejectable shell, said shell being connected by a so-called rear end to a support element of the missile and being defined around a longitudinal axis called secondary longitudinal axis.

According to the invention, said support element presents a circular arc shape centred on the main longitudinal axis and arranged orthogonally in relation to the latter, said support element being provided with an edge assembly and a crown element each presenting a circular arc shape centred on the main longitudinal axis, said crown element being arranged coaxially inside said edge assembly so as to create a housing between them, the rear end of the shell presenting a thickness adapted to said housing so as to be able to be received in said housing with a transverse contact in the bottom of the housing, a first longitudinal contact with the edge assembly and a second longitudinal contact with the crown element, said edge assembly being designed so as to enable the shell to pivot in relation to the body of the missile from a mounting position wherein the secondary longitudinal axis of the shell is substantially parallel to said main longitudinal axis (preferably the secondary longitudinal axis of the shell is parallel by being combined with said main longitudinal axis) towards at least one pivoted position wherein the secondary longitudinal axis presents a non-zero angle in relation to said main longitudinal axis, said edge assembly also being designed so as to:

- maintain at least partially said first longitudinal contact with said rear end of the shell, while the shell presents an orientation in relation to the body of the missile for which said secondary longitudinal axis presents, in relation to said main longitudinal axis, an angle smaller than a predetermined angle, called ejection angle; and
- end said first longitudinal contact with said rear end of the shell, as soon as said secondary longitudinal axis presents, in relation to said main longitudinal axis, an angle higher than or equal to said ejection angle.

Thus, thanks in particular to the configuration of said support element, combined with that of the rear end of the shell, it is possible to provide an angle (so-called ejection angle) from which the rear end of the shell is no longer radially in contact towards the outside (against said edge assembly), and the shell thus released from this contact (so-called first longitudinal contact) can be ejected from the missile, as specified below. These specific configurations and architectures, although particularly well-adapted to a missile flying at a low altitude and at a high speed, can be used on any type of missile, whatever its flying area.

Advantageously, said edge assembly comprises two circular arc edge sections, arranged symmetrically in relation to a longitudinal plane containing the main longitudinal axis, each of said edge section being designed such that its orthogonal projection over said longitudinal plane presents a rectilinear front edge forming with its rear edge an angle equal to said ejection angle, said rear edge being orthogonal to said main longitudinal axis.

In addition, advantageously, said rear end of the shell comprises, in thickness, a tapered rear portion intended to be received in a contacting manner in said housing, followed towards the front by a thick portion forming a shoulder making it possible for an auxiliary transverse contact of the shell on the front edge of the edge assembly in the mounting position.

In a first embodiment, said support element corresponds to a portion of the body of the missile.

Furthermore, in a second embodiment, said support element is an insert part, capable of being mounted on the body of the missile.

Preferably, the features, in particular thickness, are formed (preferably machined) directly in the rear end of the shell. However, in a specific embodiment, said rear end is provided with an interface portion which is fixed to the rear of the shell.

Furthermore, advantageously, the missile comprises at least one controllable actuation device, capable of generating a force likely to lead to a pivoting of the shell from the mounting position to an ejection position wherein the secondary longitudinal axis of the shell presents an angle equal to an ejection angle in relation to said main longitudinal axis of the body of the missile.

In a preferred embodiment, the missile comprises two complementary shells forming said nose cone, and an annular support part formed of two identical support elements, each of said shells being connected via its rear end to one of said support elements of the support part.

The appended figures will make it well understandable how the invention can be achieved. In these figures, identical references designate similar elements.

FIGS. 1 and 2 schematically show an example of missile to which applies the present invention, provided with a protective nose cone which is, respectively, in a mounted position on the missile and in an opening position.

Figure 1:
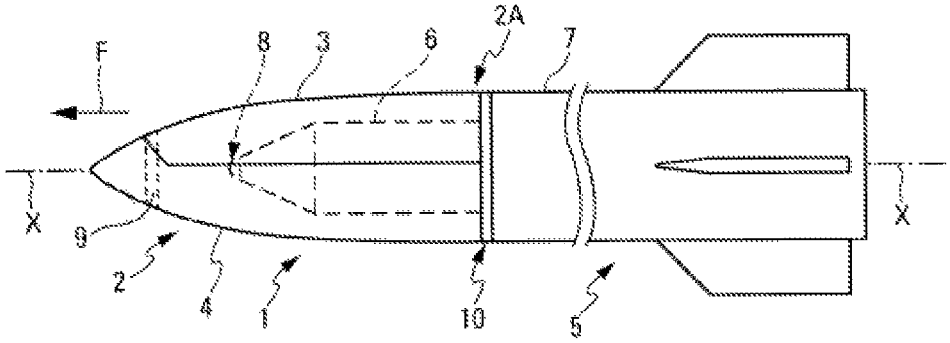
Figure 2:
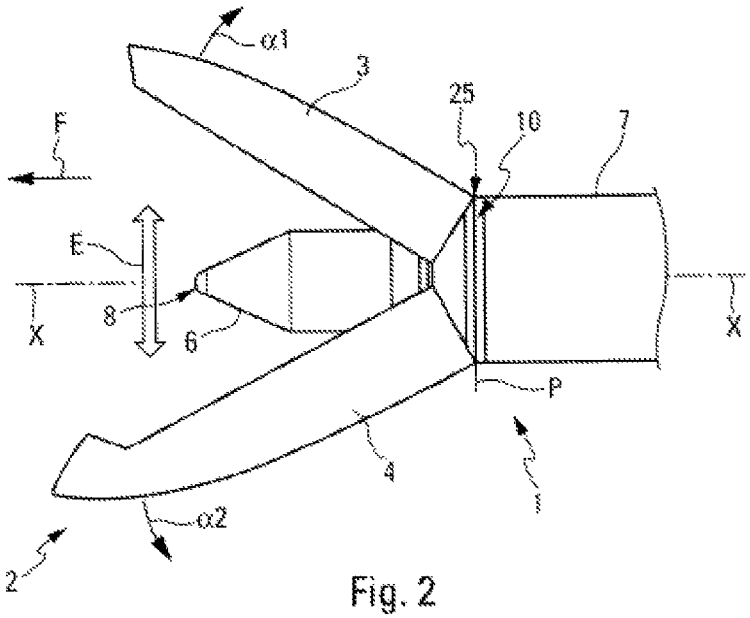

The present invention applies itself to a missile 1 represented schematically in FIGS. 1 and 2. The missile 1 is provided with a body 7, at least partially cylindrical, presenting a longitudinal axis X-X called main longitudinal axis. The missile 1 is provided at the front with a protective nose cone 2.

This protective nose cone 2 (called "nose cone 2" below) comprises a plurality of shells 3 and 4, in this case, two shells 3 and 4 in the examples considered in the description below. The adverbs "front" and "rear" are defined with respect to the movement direction F of the missile 1.

In the specific example represented in FIG. 1, the missile 1 comprises at least one droppable propellant stage 5 (to the rear) and a terminal vehicle 6 which is arranged at the front (in the movement direction F) of this propellant stage 5.

Generally, such a flying terminal vehicle 6 comprises, in particular, at least one sensor 8 arranged at the front, forming part, for example, of a seeker and likely to be temperature-sensitive. The propellant stage 5 and the terminal vehicle 6 which can be of any usual type, are not further discussed in the following description. Usually, the propellant stage(s) 5 of such a missile 1 are intended to propel said missile 1, from the firing to the approach of a target (before being neutralised by the missile 1). The terminal phase of the flight is, itself, carried out autonomously by the terminal vehicle 6, which uses, in particular, the information coming from the embedded sensor 8, for example an optoelectronic sensor intended to assist with detecting the target. To do this, the terminal vehicle 6 comprises all the usual means (not further described), which are necessary to carry out this terminal flight. Before implementing the terminal phase, the nose cone 2 is dropped, after separation of the various shells 3 and 4, by pivoting, as specified below, to release the (flying) terminal vehicle 6, which is then separated from the remainder of the missile 1.

The missile 1 is therefore provided at the front with a separable (or droppable) nose cone 2 which is intended, in particular, to thermally and mechanically protect the terminal vehicle 6. This protective nose cone 2 must however be able to be removed at the right time, in particular to make it possible to use the sensor 8 placed on the terminal vehicle 6 in the terminal phase of the flight.

In the situation of FIG. 1, the nose cone 2 is mounted on the missile 1 in a so-called (protective) mounting position. The terminal vehicle 6 represented by a dashed line is mounted inside the nose cone 2.

Figure 3:
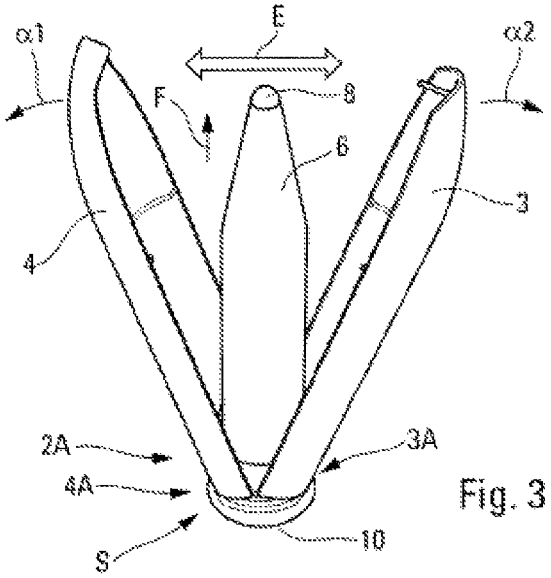
FIG. 3 shows the nose cone in an opening position.

Furthermore, in the situation of FIGS. 2 and 3, the shells 3 and 4 are in the process of being separated, by being pivoted, as illustrated respectively by the arrows $\alpha 1$ and $\alpha 2$, during an opening or dropping phase of the nose cone 2. The release (or ejection) of the shells 3 and 4 and the impulse to generate the movements illustrated by the arrows $\alpha 1$ and $\alpha 2$ (deviating from the axis X-X), can be caused by a suitable actuation device 9, for example a pyrotechnic actuator arranged preferably at the front of the nose cone 2 (inside the latter), as schematically represented in a dashed line in FIG. 1.

Although not exclusively, the present invention is particularly well-suited to a missile 1 having a flying area remaining in the atmosphere and which has kinematic performances making it possible to bring the terminal vehicle 6 to hypersonic speeds. At these high speeds, the surface temperature of the missile 1 can reach several hundred degrees Celsius under the effect of the aerothermal flow, which requires providing an effective nose cone 2 to make it possible for the stability and the performances of the structures, electronic equipment and embedded sensors. However, the present invention can be applied to a missile evolving in any case from the flying area (in and outside of the atmosphere) and for speeds going from the subsonic to the high supersonic/hypersonic.

According to the invention, the nose cone 2 is connected by a rear end 2A to a support part 10 of the missile 1, as represented in FIG. 3. In the example represented, the two shells 3 and 4 are connected, each, by the rear end 3A and 4A thereof to a support element 11, 12 (FIGS. 4 and 7) forming part of the support part 10.

Figure 4:
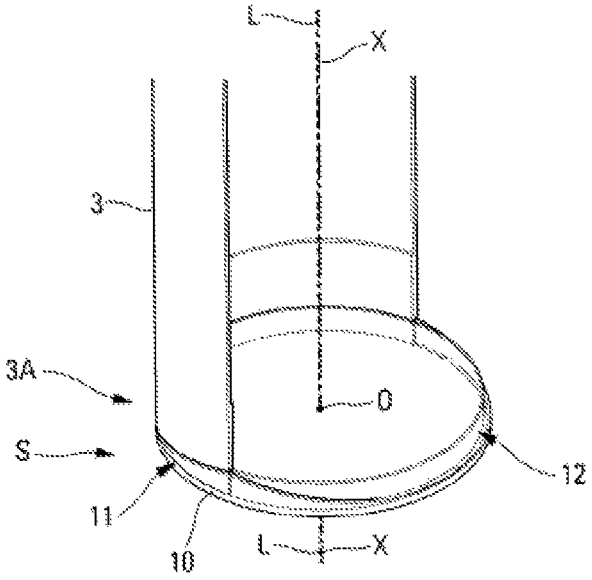
FIGS. 4 to 11 represent different schematic views showing the maintaining and ejecting of a nose cone shell in relation to the missile, these FIGS. 4 to 11 making it possible to highlight well the main features of the invention.
Figure 5:
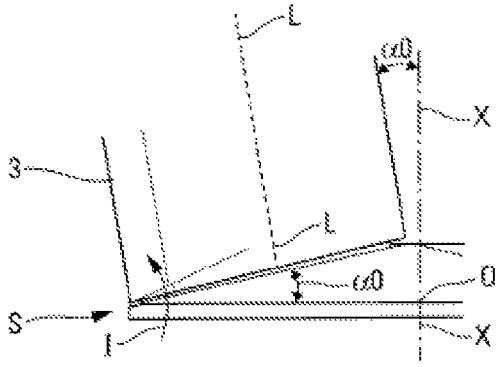

Each of these shells 3 and 4 is defined around a longitudinal axis called secondary longitudinal axis L-L, as represented in FIGS. 4 and 5, in particular.

In the preferred embodiment, the annular support part 10 is formed of two identical support elements 11 and 12. Each of the shells 3 and 4 is therefore connected to its rear end 3A, 4A to one of said support elements 11 and 12.

In addition, according to the invention, each support element 11, 12 presents a circular arc shape centred on the main longitudinal axis X-X and arranged in a plane P (FIG. 2) which is orthogonal to said axis X-X.

The controllable actuation device 9 is capable of generating a force (illustrated by a double arrow E in FIGS. 2 and 3) able to lead to the shells 3 and 4 pivoting from the mounting position of FIG. 1 to an ejection position, wherein the secondary longitudinal axis L-L of each shell 3, 4 presents an angle equal to a so-called ejection angle $\alpha 0$ in relation to said main longitudinal axis X-X of the body 7 of the missile 1, as illustrated in FIG. 5 for the shell 3 and specified below.

Figure 6:
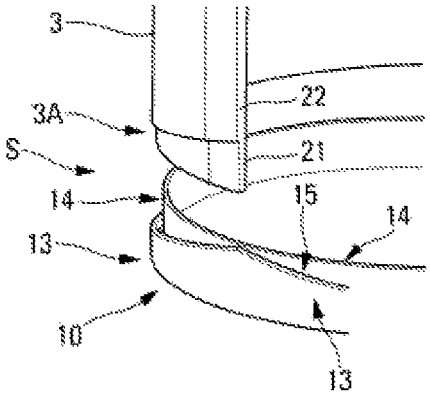
Figure 7:
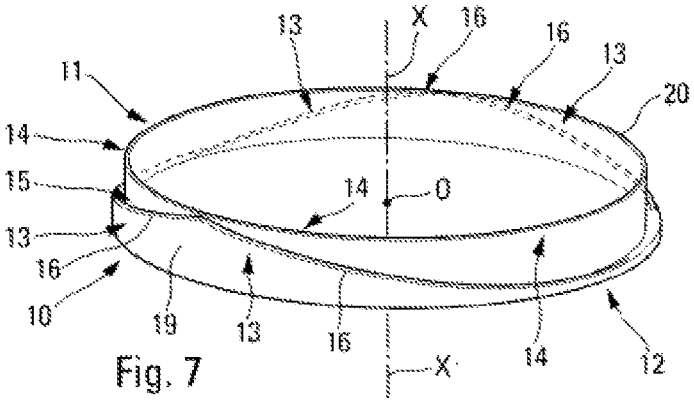

As represented in FIGS. 6 and 7, each support element 11, 12 is provided with an edge assembly 13 and a crown element 14. The edge assembly 13 and the crown element 14 present, each, a circular arc shape centred on the main longitudinal axis X-X.

In addition, the crown element 14 is arranged coaxially along the axis X-X, radially inside said edge assembly 13 so as to create, between them, a circular arc shaped housing 15.

The embodiment of the invention below is described for the shell 3. The embodiment is identical for the shell 4.

The rear end 3A of the shell 3 presents a thickness E1 adapted to the radial gap of said housing 15 so as to be able to be received in said housing 15. The rear end 3A is received in the housing 15 (in the mounting position) preferably with a three-point contact, as represented in FIG. 9B which is an enlarged view of the portion V1 of FIG. 9A, namely:

- a transverse contact C1 in the bottom 15A of the housing 15;
- a first longitudinal contact C2 (radially external) with the edge assembly 13; and
- a second longitudinal contact C3 (radially internal) with the crown element 14.

These contacts make it possible for a simple and effective maintenance of the shell 3 to its base (rear end 3A). This maintenance is achieved from the integration of the shell until it is ejected. The longitudinal contacts C2 and C3 are not however always simultaneous and/or evenly distributed over the shell 3.

In addition, the edge assembly 13 is designed so as to enable the shell 3 to pivot in relation to the body 7 of the missile 1:

- from a mounting position (wherein the secondary longitudinal axis L-L of the shell 3 is substantially parallel to said main longitudinal axis X-X, preferably the secondary longitudinal axis L-L of the shell 3 is combined with the main longitudinal axis X-X), as represented in FIG. 4;
- towards at least one pivoted position (wherein the secondary longitudinal axis L-L presents a non-zero angle in relation to said main longitudinal axis X-X), as represented in FIG. 5.

In addition, the edge assembly 13 is also designed so as to:

- maintain (at least partially) said first longitudinal contact C2 with said rear end 3A of the shell 3, while the shell 3 presents an orientation in relation to the body 7 of the missile 1 for which said secondary longitudinal axis L-L presents, in relation to said main longitudinal axis X-X, an angle smaller than said predetermined ejection angle $\alpha 0$; and
- to suppress said first longitudinal contact C2 with said rear end 3A of the shell 3, as soon as said secondary longitudinal axis L-L presents in relation to said main longitudinal axis X-X, an angle higher than or equal to said ejection angle $\alpha 0$, as represented in FIG. 5.

Thus, thanks in particular to the configuration of said support element 11, 12 combined with that of the rear end 3A, 4A of the shell 3, 4, there is an ejection angle $\alpha 0$ from which the rear end 3A, 4A of the shell 3, 4 is no longer in contact radially towards the outside (against said edge assembly 13), and the shell 3, 4 thus released from this contact (called first longitudinal contact C2) can be ejected from the missile 1.

This configuration of the support element 11, 12 combined with that of the rear end 3A, 3B of a shell 3, 4, or more generally the configuration of the support part 10 combined with that of the rear end 2A of the nose cone 2, forms a maintenance and ejection system S making it possible to maintain the nose cone 2 and making it possible for its ejection by controlling the ejection angle.

The ejection angle $\alpha 0$ can, in particular, be adapted to the missile (type, size, etc.) considered and to the ejection conditions (altitude, atmosphere, trajectory of the missile, etc.) considered. This ejection angle $\alpha 0$ can be refined by tests. Although not exclusively, the ejection angle $\alpha 0$ can, for example, be defined in a value range from 6° to 15°.

Figure 9A:
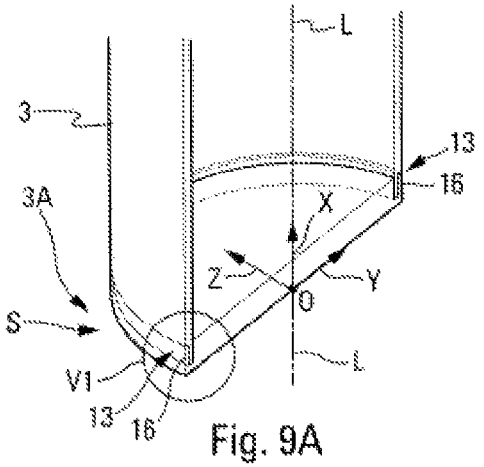
Figure 9B:
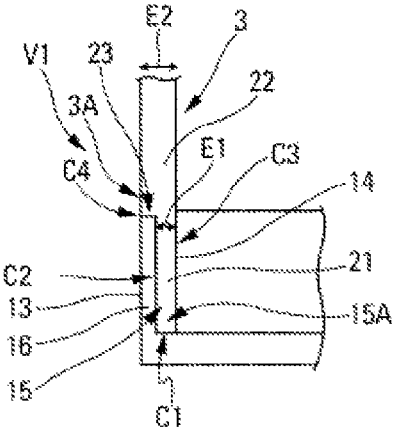
Figure 8:
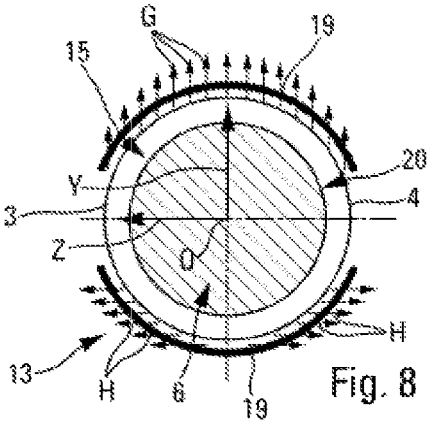

As represented in FIGS. 8 and 9A in particular, said edge assembly 13 intended for a shell 3 or 4 comprises two circular arc edge sections 16. These edge sections 16 are arranged symmetrically in relation to a longitudinal plane OXZ containing the main longitudinal axis X-X.

Figure 10A:
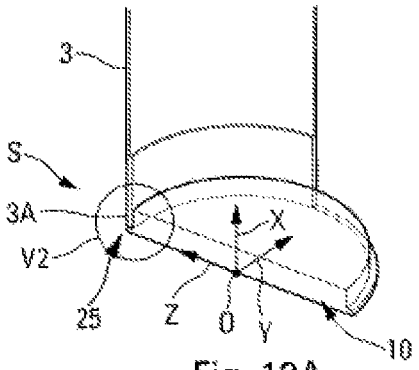

In FIGS. 9A and 10A in particular, a marker OXYZ has been represented, wherein 0 represents the intersection of the axis X-X with the plane P, OX is defined along the axis X-X in the direction F, OY is such that the plane OXY substantially corresponds to a separation plane between the shells 3 and 4, and OZ is such that the plane OXZ substantially forms a symmetry plane for each of the shells 3 and 4.

Figure 11:
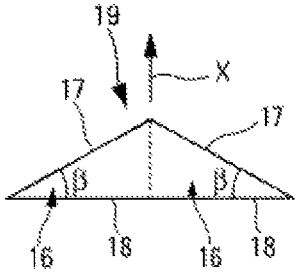

Each of said edge sections 16 is designed such that its orthogonal projection over said longitudinal plane OXZ presents a rectilinear front edge 17 forming with the (rectilinear) rear edge 18 thereof, an angle $\beta$ equal to said ejection angle $\alpha 0$, as represented in FIG. 11.

Two edge sections 16, one of which is intended for the shell 3 and the other to the shell 4 form, each time, an edge part 19, as represented in FIG. 11.

The support part 10 therefore comprises two edge parts 19 of this type, which are systematically mounted in relation to the longitudinal plane OXZ, as shown in FIG. 8. In a specific embodiment, the two edge parts 19 are made of one (single) part of one single holding.

Likewise, the support part 10 comprises two crown elements 14, identical and symmetrical in relation to the plane OXY. These two crown elements 14 form a crown 20 (FIG. 7) centred on the axis X-X. This crown 20 is preferably an insert part. It can also correspond to a portion of the external surface of the terminal vehicle 6 as illustrated in FIG. 8.

In addition, the rear end 3A of the shell 3 comprises, in thickness, a tapered rear portion 21 (of thickness E1) intended to be received in a contacting manner in said housing 15, followed towards the front of a thick portion 22 (of thickness E2 higher than the thickness E1) forming a shoulder 23 making it possible for an auxiliary transverse contact C4 of the shell 3 on the front edge 17 of the edge assembly 13 in the mounting position, as represented in FIG. 9B. This shoulder 23 presents a shape adapted to that of the front edges 17 of the two associated edge sections 16.

Figure 10B:
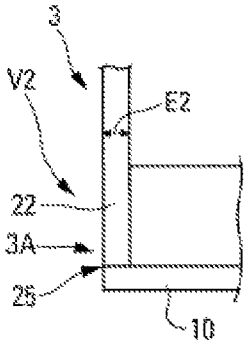

Thus, as represented in FIGS. 10A and 10B, at the level of the enlarged zone V2 of FIG. 10B corresponding to the intersection of the axis OZ with the shell 3, the rear end 3A of the shell 3 does not comprise any tapered portion but only the thick portion 22 of thickness E2.

The system S makes it possible to maintain the shells 3 and 4 as illustrated by the arrows G in FIG. 8, and a pivoting of the shells 3 and 4 as illustrated by the arrows H in this FIG. 8.

In addition, the pivoting of the shell 3 is achieved without any hinges by simple contact at the level of a zone 25 (FIGS. 2, 10A, 10B) located in the proximity of the intersection of the axis OZ with the shell 3.

In a first embodiment, the support part 10 corresponds to a portion of the body 7 of the missile 1.

Furthermore, in a second embodiment, the support part 10 is an insert part, capable of being mounted (and fixed) on the body 7 of the missile 1.

Moreover, preferably, the features, in particular of thickness (E1 and E2) are formed (preferably machined) directly in the rear end 3A, 4A of the shell 3, 4. However, in an embodiment variant (not represented), the rear end 3A, 4A of each shell 3, 4, presenting these features, is provided with an interface part which is fixed at the rear of the shell 3, 4.

The functioning of the maintenance and ejection system S (controlling the ejection angle), such as described above, is as follows, during the ejection.

When the shells 3, 4 of the nose cone 2 must be separated, the actuation device 9 is activated to generate forces illustrated by the double arrow E (in FIGS. 2 and 3) in order to make the shells 3 and 4 pivot in the directions illustrated by the arrows $\alpha$1 and $\alpha$2 (FIG. 2). Thanks to the system S, the shells 3 and 4 are maintained on the support part 10 until the pivoting angles a1 and $\alpha$2 reaching the value a0 of ejection angle. In this pivoting position, the shells 3 and 4 are no longer maintained by the support part 10 and are released from the missile 1, from which they deviate, which results in the dropping of the nose cone 2.

The abovementioned features of the maintenance and ejection system S, and in particular the configuration of the support part 10 and the rear ends 3A, 4A of the shells 3, 4, make it possible to control the separation angle of the shells 3 and 4 of the nose cone 2. The ejection angle is an essential parameter which is difficult to control by usual solutions, according in particular to the ejection conditions (altitude, atmosphere, trajectory of the missile, etc.). Thanks to this controlling, it can be ensured that the ejection does not damage the missile and does not impede its terminal phase.

The system S functions in any case from the flying area (in and outside of the atmosphere) of a missile 1 and for speeds going from the subsonic to the high supersonic/hypersonic.

The system S thus presents numerous advantages. In particular:

- it is based on a purely mechanical architecture, which gives it an excellent repeatability;
- it is based on a passive, simple, reliable and robust solution, which is adaptable to all types of missiles provided with ejectable (nose cone) shells;
- the simplicity of the geometry minimises the mass embedded on the missile 1, and guarantees its ease of production and integration;
- in storage, logistical transport and flight phases, before de-capping, the system S makes it possible to regain forces between the shells 3 and 4; and
- the architecture of the system S is fully configurable according to the flying area and for each of the shells 3 and 4 (with a possible asymmetry, if needed).

The invention claimed is:

1. A missile, comprising:

a body having a main longitudinal axis; and at least one separable nose cone, said separable nose cone comprising at least one ejectable shell, said ejectable shell being connected by a rear end to a support element of the missile and being defined around a secondary longitudinal axis, wherein said support element presents a circular arc shape centred on and arranged orthogonally in relation to the main longitudinal axis, said support element being provided with an edge assembly and a crown element, each presenting a circular arc shape centred on the main longitudinal axis, said crown element being arranged coaxially inside said edge assembly so as to create, between the edge assembly and the crown element, a housing, the rear end of the ejectable shell presenting a thickness configured to be received in said housing with a transverse contact in a bottom of the housing, a first longitudinal contact with the edge assembly and a second longitudinal contact with the crown element, said edge assembly being configured to enable a pivoting of the ejectable shell in relation to the body of the missile from a mounting position, wherein the secondary longitudinal axis of the ejectable shell is substantially parallel to said main longitudinal axis, towards at least one pivoted position, wherein the secondary longitudinal axis presents a non-zero angle in relation to said main longitudinal axis, said edge assembly also being configured to:

maintain at least partially said first longitudinal contact with said rear end of the ejectable shell, while the ejectable shell has an orientation in relation to the body of the missile for which said secondary longitudinal axis has, in relation to said main longitudinal axis an angle that is smaller than a predetermined ejection angle; and end said first longitudinal contact with said rear end of the ejectable shell as soon as said secondary longitudinal axis has, in relation to said main longitudinal axis, an angle higher than or equal to said predetermined ejection angle.

2. The missile according to claim 1, wherein said edge assembly comprises two circular arc edge sections, arranged symmetrically in relation to a longitudinal plane containing the main longitudinal axis, each of said circular arc edge sections being configured such that an orthogonal projection thereof on said longitudinal plane presents a rectilinear front edge forming, with a rear edge thereof, an angle equal to said predetermined ejection angle, said rear edge being orthogonal to said main longitudinal axis.

3. The missile according to claim 2, wherein said rear end of the ejectable shell comprises a tapered rear portion configured to be received in said housing, followed towards a front of a thick portion forming a shoulder, said shoulder configured to enable an auxiliary transverse contact of the ejectable shell on the rectilinear front edge of the edge assembly in the mounting position.

4. The missile according to claim 2, wherein said support element corresponds to a portion of the body of the missile.

5. The missile according to claim 2, wherein said support element is an insert part, configured to mount on the body of the missile.

6. The missile according to claim 2, wherein said rear end is provided with an interface part which is fixed to the ejectable shell.

7. The missile according to claim 2, further comprising at least one controllable actuation device configured to generate a force that leads to the ejectable shell pivoting from the mounting position to an ejection position, wherein the secondary longitudinal axis of the ejectable shell presents an angle equal to the predetermined ejection angle in relation to said main longitudinal axis of the body of the missile.

8. The missile according to claim 2, further comprising two complementary shells forming said separable nose cone, and an annular support part formed of two identical support elements, each of said ejectable shells being connected via a rear end to one of said support elements of the annular support part.

9. The missile according to claim 1, wherein said rear end of the ejectable shell comprises a tapered rear portion configured to be received in said housing, followed towards a front of a thick portion forming a shoulder, said shoulder configured to enable an auxiliary transverse contact of the ejectable shell on the rectilinear front edge of the edge assembly in the mounting position.

10. The missile according to claim 9, wherein said support element corresponds to a portion of the body of the missile.

11. The missile according to claim 9, wherein said support element is an insert part, configured to mount on the body of the missile.

12. The missile according to claim 9, wherein said rear end is provided with an interface part which is fixed to the ejectable shell.

13. The missile according to claim 9, further comprising at least one controllable actuation device configured to generate a force that leads to the ejectable shell pivoting from the mounting position to an ejection position, wherein the secondary longitudinal axis of the ejectable shell presents an angle equal to the predetermined ejection angle in relation to said main longitudinal axis of the body of the missile.

14. The missile according to claim 9, further comprising two complementary shells forming said separable nose cone, and an annular support part formed of two identical support elements, each of said ejectable shells being connected via a rear end to one of said support elements of the annular support part.

15. The missile according to claim 1, wherein said support element corresponds to a portion of the body of the missile.

16. The missile according to claim 15, further comprising two complementary shells forming said separable nose cone, and an annular support part formed of two identical support elements, each of said ejectable shells being connected via a rear end to one of said support elements of the annular support part.

17. The missile according to claim 1, wherein said support element is an insert part, configured to mount on the body of the missile.

18. The missile according to claim 1, wherein said rear end is provided with an interface part which is fixed to the ejectable shell.

19. The missile according to claim 1, further comprising at least one controllable actuation device configured to generate a force that leads to the ejectable shell pivoting from the mounting position to an ejection position, wherein the secondary longitudinal axis of the ejectable shell presents an angle equal to the predetermined ejection angle in relation to said main longitudinal axis of the body of the missile.

20. The missile according to claim 1, further comprising two complementary shells forming said separable nose cone, and an annular support part formed of two identical support elements, each of said ejectable shells being connected via a rear end to one of said support elements of the annular support part.

* * * * *